US007014459B2

(12) United States Patent
Long

(10) Patent No.: US 7,014,459 B2
(45) Date of Patent: Mar. 21, 2006

(54) SLIDING GLOBE ASSEMBLY FOR LANTERN

(75) Inventor: Norris Richard Long, Wichita, KS (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 10/418,620

(22) Filed: Apr. 18, 2003

(65) Prior Publication Data

US 2004/0209210 A1 Oct. 21, 2004

(51) Int. Cl.
*F10H 1/00* (2006.01)

(52) U.S. Cl. ..... 431/112; 431/113; 431/110

(58) Field of Classification Search ..... 431/109, 431/110, 111, 112, 113; 362/179
See application file for complete search history.

(56) References Cited

U.S. PATENT DOCUMENTS 1,143,238 A * 6/1915 Sutter ..... 362/179
4,089,635 A * 5/1978 Sivignon ..... 431/111
4,599,583 A 7/1986 Beckham et al.
4,702,690 A * 10/1987 Sommers et al. ..... 431/110
5,441,037 A * 8/1995 Yen ..... 126/258
5,613,760 A * 3/1997 Dunn ..... 362/161
5,639,231 A 6/1997 May et al.
5,902,100 A 5/1999 Long

FOREIGN PATENT DOCUMENTS

| | | |
|---|---|---|
| DE | 40863 | 10/1887 |
| DE | 44414 | 9/1888 |
| DE | 48349 | 8/1889 |
| DE | 213928 | 10/1909 |

* cited by examiner

*Primary Examiner*—Alfred Basichas
(74) *Attorney, Agent, or Firm*—Leydig, Voit & Mayer, Ltd.

(57) ABSTRACT

A lantern which may be manipulated between a closed position in which it surrounds a mantle or mantles for the lantern to a second, opened position in which the globe has been moved or otherwise manipulated to provide access to the mantle or mantles. As an example, the globe may slide upward relative to the mantles so as to expose the mantles for changing. A globe for the lantern includes a frosted band located on a circumference radially outward from the mantle or mantles. The frosted band minimizes glare from the lantern, and the combination of the frosted band and clear sections located above and below the band provide illumination substantially equal to a clear globe.

10 Claims, 5 Drawing Sheets

SLIDING GLOBE ASSEMBLY FOR LANTERN

TECHNICAL FIELD OF THE INVENTION

The present invention relates to lanterns, and more particularly, to installation or replacement of a mantle in a lantern.

BACKGROUND OF THE INVENTION

Lanterns that burn liquid fuel or LP fuel are well known. Such lanterns include a burner assembly to which the fuel is delivered and one or more catalytic mantles which are mounted on the burner assembly. The fuel burns within the catalytic mantles and the mantles incandesce and provide a bright light. The mantles are usually surrounded by a glass cylindrical globe.

Mantles are generally formed from mesh material, and are shaped like a small bag with one open end. The open end is secured around the outlet end of a burner tube of the burner assembly of a lantern. The mantle may be attached, for example, by a drawstring. Alternatively, the mantle may be attached by a spring clip, such as is shown in U.S. Pat. No. 5,639,231.

One problem encountered with prior art lanterns is that the mantles are difficult to access for installing or replacement of one or more mantles. Typically, a ventilator cap of the lantern and the globe have to be removed from the lantern so as to provide access to the mantles. The ventilator cap assembly often is attached by a threaded connection, such as a nut, which requires some time to remove, as well as some dexterity on the part of the user. In addition, because handling of the globe and ventilator cap assembly is required, a user must wait for these items to cool before removing. Waiting for these components to cool may take some time.

Another problem with prior art lanterns is that the mantles for the lanterns often are very bright, especially when viewed through a clear globe. In the past, some manufacturers have used completely frosted globes to reduce the glare from the mantles. However, it has been found that these completely frosted globes block a large amount of light produced by a lantern, and thus significantly reduce the illumination provided by the lantern.

SUMMARY OF THE INVENTION

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

The present invention provides a lantern which may be manipulated between a closed position in which the globe surrounds a mantle or mantles for the lantern to a second, opened position in which the globe has been moved or otherwise manipulated to provide access to the mantle or mantles. As an example, the globe may slide upward relative to the mantles so as to expose the mantles for changing.

Because the lantern of the present invention provides translation of the globe relative to the mantles, instead of removal of the globe, the lantern of the present invention does not have to be disassembled for replacement or installation of the mantles. In addition, in accordance with one aspect of the present invention, the lantern is easily manipulated by a user with limited dexterity, such as a user with arthritis. In accordance with another aspect, a user may translate the globe relative to the mantle by using a single hand.

If desired, a release mechanism may be provided to unlock the globe prior to the globe being translated relative to the mantle or mantles. A mechanism, such as a spring or a worm gear, may be provided for biasing or advancing the globe into the translated position.

In accordance with another aspect of the present invention, the globe and a ventilator cap assembly may be provided on a sliding rail that is capable of moving relative to the mantles. A release mechanism may be actuated so that the sliding may commence, permitting the globe to be moved upward.

In accordance with another aspect of the present invention, a mechanism is provided that supplies friction against the translated movement of the globe relative to the mantles. The friction mechanism permits movement of the globe relative to the mantles to be stopped at any point, without the globe automatically returning by gravity to the closed position. As an example, a leaf spring may be provided that engages rails upon which the globe is mounted and resists sliding of the rails relative to the mantles.

In accordance with another aspect of the present invention, a globe for the lantern includes a frosted band located on a circumference of the globe radially outward from the mantle or mantles. The frosted band minimizes glare from the lantern, and the combination of the frosted band and clear sections located above and below the band provide illumination substantially equal to a clear globe, without the associated glare.

Other advantages will become apparent from the following detailed description when taken in conjunction with the drawings, in which:

DETAILED DESCRIPTION

In the following description, various aspects of the present invention will be described. For purposes of explanation, specific configurations and details are set forth in order to provide a thorough understanding of the present invention. However, it will also be apparent to one skilled in the art that the present invention may be practiced without the specific details. Furthermore, well-known features may be omitted or simplified in order not to obscure the present invention. In addition, to the extent that orientations of the invention are described, such as "top," "bottom," "front," "rear," and the like, the orientations are to aid the reader in understanding the invention, and are not meant to be limiting.

Figure 1:
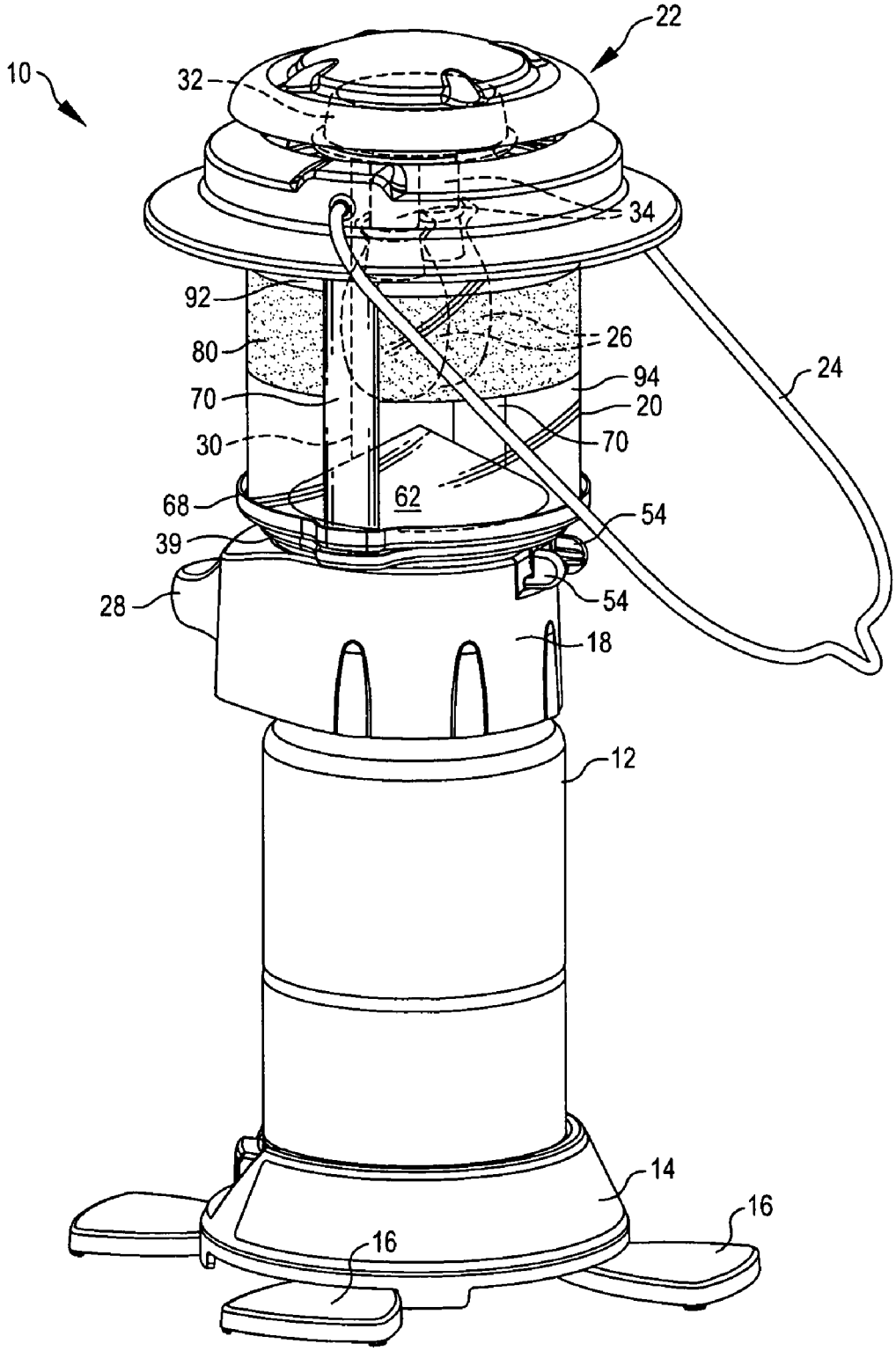
FIG. 1 is a side perspective view of a lantern incorporating the present invention.

Referring now to the drawings, in which like reference numerals represent like parts throughout the several views, FIG. 1 shows a lantern 10 incorporating the present invention. In the embodiment shown in FIG. 1, the lantern 10 includes a propane tank 12. However, the aspects of the present invention may be used with a lantern utilizing any kind of fuel, including lanterns that utilize fuel sources such as liquid fuel.

The propane tank 12 is situated on top of a tank base 14 having feet 16. A cylindrical collar 18 is mounted on top of the propane tank 12 and may, for example, be threaded onto a male coupling on the top of the propane tank 12 (not shown, but known in the art). In the embodiment shown in the drawings, the burner assembly (described later) for the lantern 10 is mounted on the cylindrical collar 18, but a different style of base may be provided. A globe 20 is mounted above the cylindrical collar 18, and a ventilator cap assembly 22 is situated over the globe 20. A bail 24 is attached to the ventilator cap assembly 22 and may be used to carry or hang the lantern 10.

One or more mantles 26 are positioned within the globe 20. In the embodiment shown in FIG. 1, two mantles 26 are used. However, the features of the present invention may be utilized with a lantern having one mantle or any number of mantles.

In summary, the present invention is directed a lantern (e.g., the lantern 10) having a globe (e.g., the globe 20) that is capable of translating relative to mantles (e.g., the mantles 26) between a closed position in which the globe surrounds the mantles and an opened position where access to the mantles is provided for a user so that the user may install, replace, or light the mantles. In both the closed and opened positions, the globe is attached to the lantern.

Figure 2:
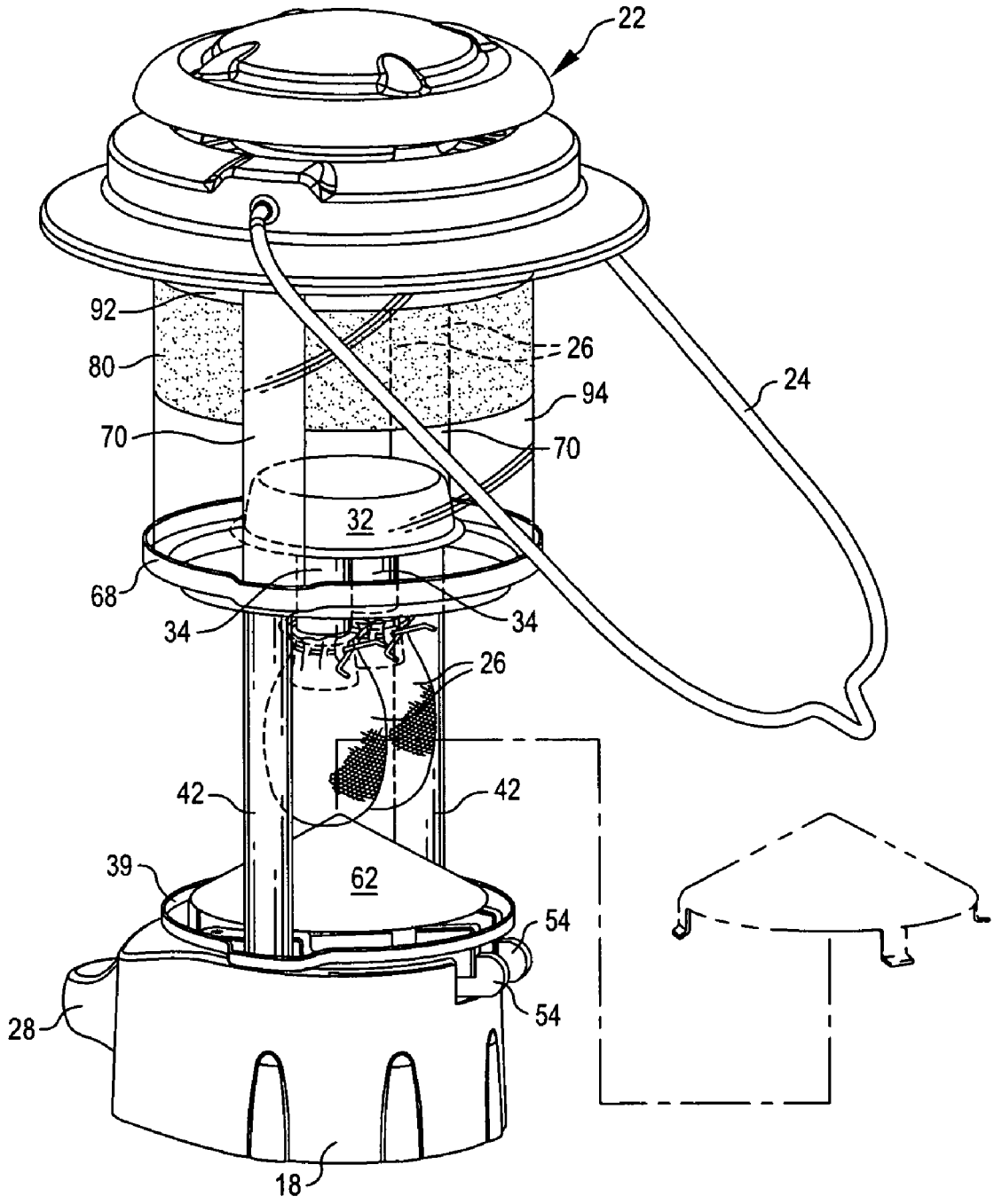
FIG. 2 is a side perspective view of the lantern of FIG. 1, with a base and propane tank removed for detail, and with a globe assembly translated upward relative to a mantle base.

The closed and opened positions are shown in FIGS. 1 and 2, respectively. FIG. 1 shows a closed position in which the mantles 26 are surrounded by the globe 20 and are generally not accessible by a user, and FIG. 2 shows a translated position in which the globe 20 has been moved relative to the mantles 26 and the mantles 26 may be accessed by a user. In the embodiment shown, the globe 20 is moved upward relative to the mantles 26.

Put another away, the globe and associated components (the "globe assembly") may be said to translate relative to the mounting location of the mantles, or a "mantle base." In general, as referred to herein, the "mantle base" is any structure on which a mantle or mantles 26 are mounted. In addition, as used herein, "globe assembly" is meant to mean any structure mounted to move with the globe 20, and may mean only the globe.

In general, lanterns (e.g., the lantern 10) include a burner assembly for mixing air and fuel and providing the mixed air and fuel mixture to the mantles. The components for a burner assembly of a lantern are known, but the burner assembly of the lantern 10 is generally described in this disclosure for the benefit of the reader. The lantern 10 includes a regulator (not shown, but known in the art) for dropping the pressure of the fuel from the propane tank 12 to a usable pressure for the lantern. The regulator is typically connected to a valve (also not shown) that is connected to a control knob 28, which is mounted on the cylindrical collar 18 in the embodiment shown in the drawings. Rotation of this control knob 28 increases or decreases the flow of fuel to the burner assembly.

In the burner assembly shown in the drawings, an air/fuel intake tube 30 (FIG. 3) extends upward from the cylindrical collar 18 to a manifold 32, very often called a "peanut" in the field of lanterns. A pair of burner tubes 34 extend downward from the manifold 32 to mantle mounts 36.

In the embodiment shown in the drawings, an igniter 38 is provided for lighting the lantern 10. The use of such igniters is known, and the details of their structure and operation are not provided herein. Alternatively, the lantern 10 may be lit manually, such as by a match.

In operation, a user rotates the control knob 28, causing the igniter 38 to spark, and gas to be supplied through the air/fuel intake tube 30, the manifold 32 and out of the burner tubes 34 at the mantle mounts 36. The mantles 26, which are typically made of a catalytic material, such as yttrium, light and remain lit as long as fuel is supplied to the mantles 26.

In the embodiment shown, the burner tubes 34 extend downward. However, the aspects of the present invention may be utilized in a lantern which has burner tube that extend upward, sideways, or at any angle. However, as is known in the art, the structure of the burner assembly shown in FIG. 3 is advantageous in that the mantles 26, once lit, provide pre-heating of the fuel mixture in the air/fuel intake tube 30, the manifold 32, and the burner tubes 34.

The mantles 26 may be tied, clipped, or otherwise attached to the mantle mounts 36. One structure that may be used to attach the mantles 26 to the mantle mounts 36 is disclosed in U.S. Pat. No. 5,637,231. That patent discloses a spring clip for attaching a mantle to a mantle mount.

Figure 3:
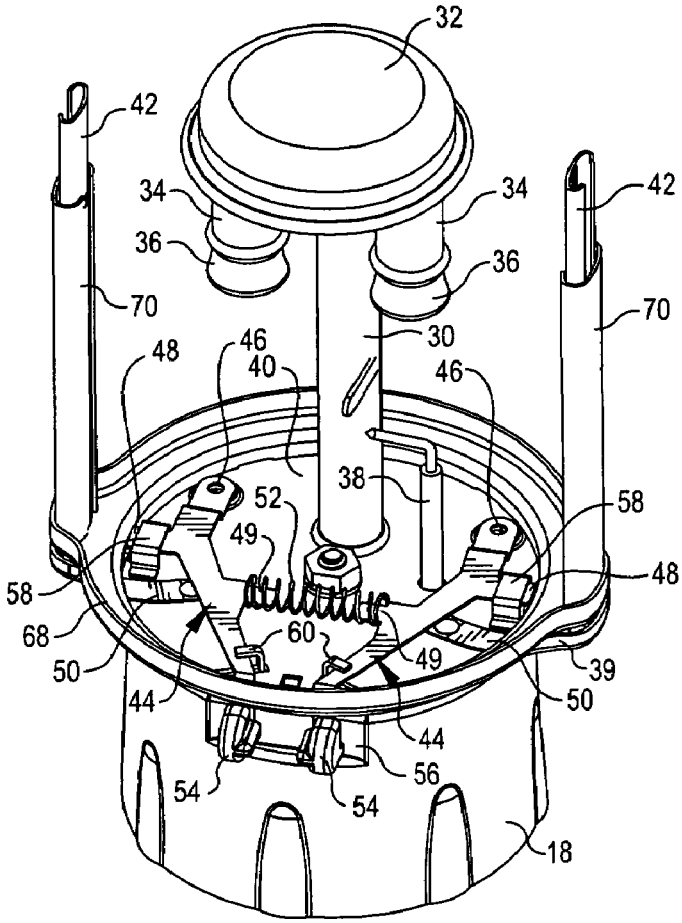
FIG. 3 is a top perspective view of the lantern of FIG. 2, with the globe assembly removed to show detail of a cylindrical collar and frame bottom for the lantern.

FIG. 3 shows details of a frame bottom 40 (also shown in FIG. 2) mounted over the top of the cylindrical collar 18 and having upturned flanges 39 about its periphery. A pair of rails 42 extend upward from opposite outer edges of the frame bottom 40. The rails 42 shown in the drawing are hollow and open along one side extending along a length of the rail and aligned at an outside portion of the lantern 10. Thus, a cross section of the rails 42 forms a "C," although other configurations of rails may be used.

A pair of levers 44 are mounted on the top of the frame bottom 40. These levers 44 are mirror images of one another, so for the purpose of brevity only one lever 44 will be described. However, the opposite lever 44 includes similar structure, but is arranged on an opposite side of the frame bottom 40 and as a mirror image to the opposite lever. Thus, for the purposes of this description, only a single "lever 44" will be described, but it is understood that the other lever has similar features, albeit a mirror image.

The lever 44 is rotatably mounted at one end about a pin 46. A latch 48 extends outward from the lever 44 and is spaced from the pin 46 approximately one fourth of the length along the lever 44. An inner protrusion 49 extends inward from the opposite side of the lever 44 approximately half way down the length of the lever. A leaf spring 50 extends under the lever 44 and is attached to the frame bottom. The outer end of the leaf spring 50 extends to the edge of the frame bottom 40. The function of the leaf spring 50 is described below.

A coil spring 52 is mounted on the inner protrusion 49 of each of the levers 44, and biases the two levers apart. The distal end of each of the levers 44 extends out of the cylindrical collar 18. A button 54 is located on each of these distal ends. An indentation 56 is located on the front of the cylindrical collar 18 and provides easy access to the buttons 54 on the two levers 44. In addition, the fact that the buttons 54 are mounted in the indentation reduces the chance that a user may accidentally bump into the buttons 54 when brushing past the lantern 10.

A retainer 58 extends over and slidably receives the latch 48. A second retainer 60 extends over a distal end of the lever 44 just inside the cylindrical collar 18 on the frame bottom 40, and also slidably receives the lever. The two retainers 58, 60 maintain alignment of the lever 44 so that the lever may move along a horizontal path when rotated about the pin 46. Other structures may be used to stabilize the lever 44 as needed.

A heat shield 62 (removed in FIG. 3 to show detail, but shown in FIG. 2) extends over the levers 44 and protects the levers 44, the frame bottom 40, and the cylindrical collar 18 from the heat produced while the mantles 26 are lit. The heat shield 62 is preferably conically shaped so that it may aid in the reflection of light out of the globe 20. Although not shown in the drawings, the heat shield 62 may include a slot for receiving the air/fuel intake tube 30, and a hole or slot for receiving the igniter 38.

A pan 68 is positioned underneath a bottom edge of the globe 20. The pan 68 is configured to support the globe 20 and to fit against the flanges 39 on the frame bottom 40 when the globe assembly is in the closed position.

Figure 4:
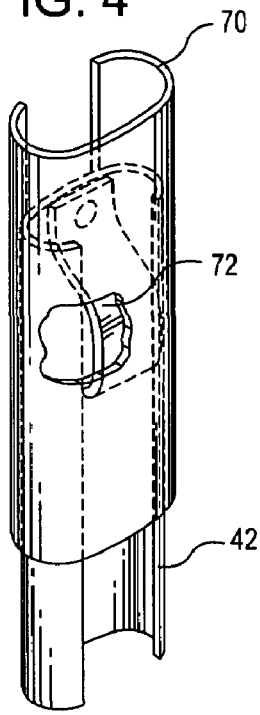
FIG. 4 is a partial cut-away side perspective view of rails that may be used to attach the globe assembly to the mantle base of the lantern of FIG. 1.

The ring 68 is attached to the ventilator cap assembly 22 by a pair of rails 70. The rails 70 may attach directly to the ring 68 and/or the ventilator cap assembly 22, or an intermediate structure may be provided for one or both of these. For example, a ring (not shown) may attach to the top of the rails 70 and the ventilator cap assembly 22 may be installed on top of the ring. The rails 70, like the rails 42, are hollow and open on one side, in the embodiment shown, the inside. The rails 70 are configured to fit over and around the rails 42, as can be best seen in FIGS. 3 and 4. (0045) A leaf spring 72 is mounted on the inside of each of the rails 42, one of which can best be seen in FIG. 4. Each leaf spring 72 is attached opposite the opening in the C-shaped rail 42, and extends through the opening. The outer portion of each leaf spring 72 engages the inner surface of the corresponding rail 70. The function of the leaf springs 72 is described below.

Figure 7:
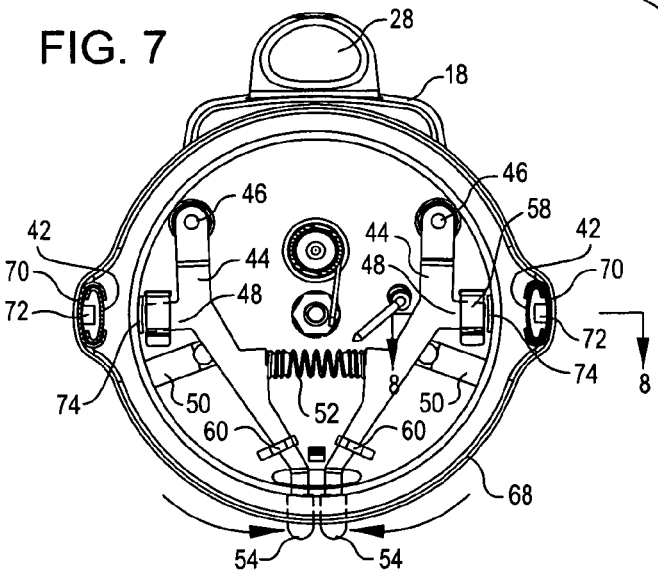
FIG. 7 is a top view of the frame bottom of FIG. 3, similar to FIG. 5, but with a release mechanism on the frame bottom engaged.
Figure 8:
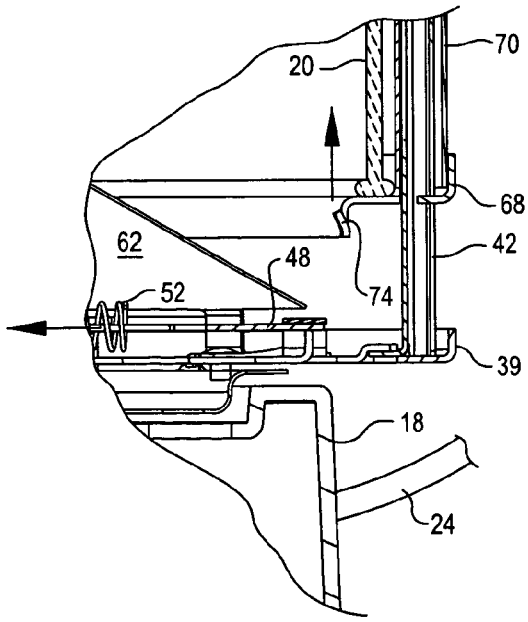
FIG. 8 is a cut-away view taken along the section lines 8—8 of FIG. 7.

The ring 68 includes two tabs 74, one each extending inward from each side of the ring 68. The tabs 74 are punched out of the inner wall of the ring 68, with a top of each tab extending inward and the bottom of each tab still connected to the ring. One of the tabs 74 is best shown in FIG. 8, and the tops of the two tabs can be seen in FIG. 7. The tabs 74 are arranged so that they engage and may be locked under the latches 48 on the levers 44, the function of which is described further below.

Figure 5:
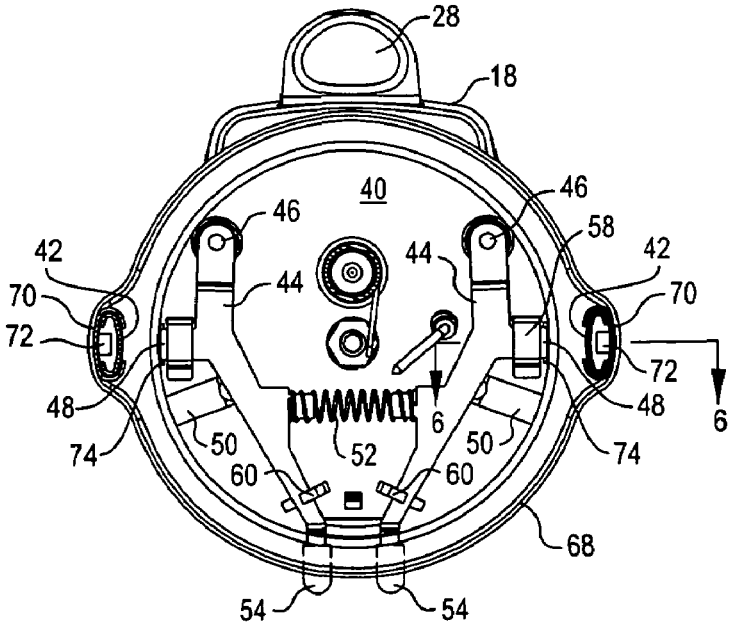
FIG. 5 is a top view of the frame bottom of FIG. 3, with portions of a burner assembly removed to show detail.
Figure 6:
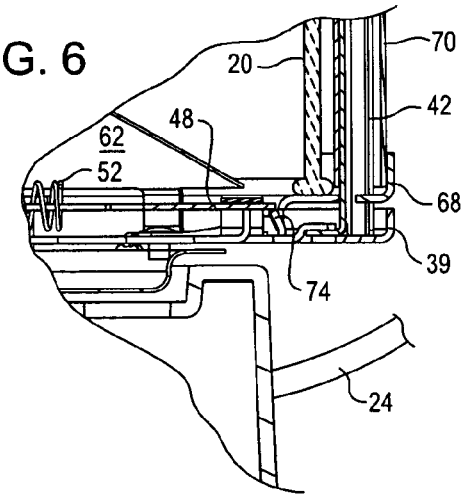
FIG. 6 is a cut-away view taken along the perspective lines 6—6 of FIG. 5.

Turning now to the operation of the lantern 10, a user desiring to change the mantles 26 on the lantern 10 first releases the globe assembly from the mantle base. In the embodiment shown in the drawings, the tabs 74 extend under the latches 48 when the globe assembly is in the closed position (shown in FIG. 1). The interlocking connection of one of the tabs 74 and the corresponding latch 48 is shown in FIG. 6, and the two tabs can be seen situated below the two latches in FIG. 5. Because the tabs 74 extend underneath the latches 48, the ring 68, and therefore the globe 20, cannot be moved upward. Although described with reference to tabs, other protrusions may be situated on the ring 68 or may be otherwise associated with the globe and may be engaged by latches of many different configurations. Also, in an alternative embodiment, a latch may be associated with the globe that may engage a protrusion on the frame bottom 40 or cylindrical collar 18.

To release this interconnection, a user grasps the two buttons 54 on the levers 44, for example with a thumb and forefinger, and presses the two buttons together. This operation moves the distal ends of the levers 44 inward relative to one another, from the position in FIG. 5 to the position in FIG. 7. Rotation of the levers 44 around the pins 46 moves the latches 48 inward so that they are no longer situated over the tabs 74. With the latches 48 removed, the tabs 48 and therefore the pan 68 and the globe 20 are free to move upward.

Preferably, a spring or other mechanism may be provided so that once the tabs 74 are released from the latches 48, the pan 68 is urged slightly upward. In the embodiment shown in the drawings, the leaf springs 50 serve this function. The leaf springs 50 are position so that their distal ends engage the bottom of the pan 68. The leaf springs 50 push the pan 68 away from the ring 39. In this manner, a user may press the buttons 54 together, and the pan 68 pops upward so that if the user releases the buttons 54, the latches 48 are no longer aligned so that they may extend over the top of the tabs 74, and thus do not extend back over the tabs 74. In this manner, a user may use a single hand to release the globe assembly and it will not lock back after release of the levers 44.

If desired, a latching mechanism may not be employed to hold the globe assembly in place. Instead, the globe assembly may rely upon gravity or the friction of movement of the globe relative to the mantles to maintain its position. In addition, different latching mechanisms may be used, such as hooks, levers, clips, screws, or any other structure that is capable of temporarily locking the globe assembly in place. However, the latching mechanism shown in the drawings works particularly well in that it holds both sides of the globe assembly down, thus providing stable support for the globe assembly, and in that the latching mechanism may be very easily released by a user using only one hand. In addition, because the buttons 54 are conveniently located on the outside of the lantern 10 and are provided in the indentation 56 for easy access, the user may release the latching mechanism even if the user has relatively little dexterity, for example a user that has arthritis.

The globe assembly may then be translated relative to the mantle base so as to expose the mantles 26. In the embodiment shown in the drawings, this action is performed by sliding the globe assembly upward relative to the mantle base. A user may, for example, grasp the bail 24 and lift up so that the rails 70 of the globe assembly and the globe assembly slide upward along the rails 42. The leaf springs 72 provide slight resistance to this movement, and preferably have sufficient spring tension so that the friction of the leaf spring 72 against the inner surface of the rail 70 prevents the globe assembly from falling (i.e., sliding back down the rails 42) if the globe assembly is released during the lifting process. This feature also permits a user to position the globe assembly at any location between the fully closed and fully translated positions.

However, the spring tension is preferably not so strong that it is difficult to slide the globe assembly upward. More particularly, the friction provided by the spring tension is preferably selected so that a user may, after the globe assembly is released, lift the globe assembly with one hand (e.g., by lifting the bail 24), and the weight of the part of the lantern 10 that does not translate prevents the mantle base from being lifted with the globe assembly. Thus, a user may translate the globe assembly with a single hand. If the latching mechanism described above is used, this permits the user to unlock the globe assembly and translate the globe assembly relative to the mantle base with a single hand. The user may, however, want to grasp the lantern with the free hand to keep it steady during the movement between the positions.

Resistance to sliding movement of the globe assembly relative to the mantle base may be provided in other ways. As nonlimiting examples, a detent may be provided that engages holes on the way up the rail 42, a bushing may be provided between the rails 42 and 70, or the connection between the rails may be tightly toleranced.

Figure 9:
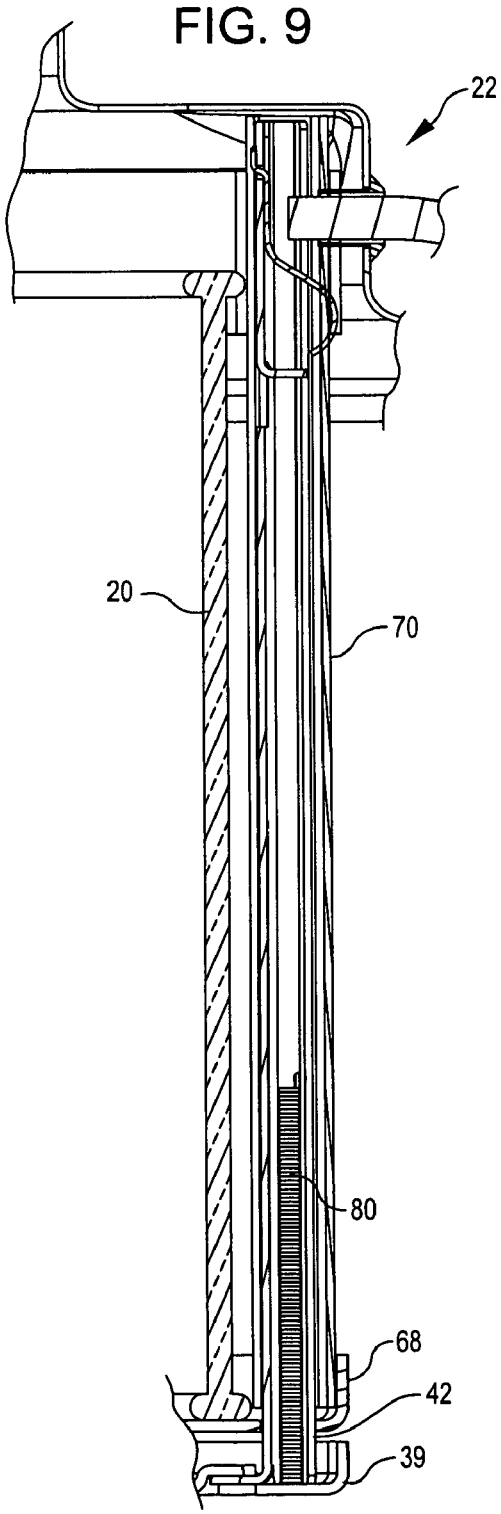
FIG. 9 is a cut-away view showing an alternate embodiment of a rail system that may be used with the lantern of FIG. 1.
Figure 10:
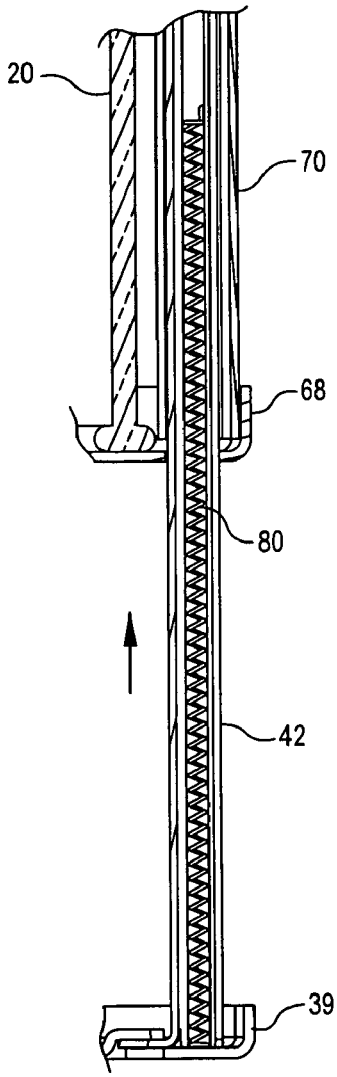
FIG. 10 is a cut-away view, similar to FIG. 9, showing a globe assembly translated relative to the rest of the lantern.

Translation may occur in a variety of other different ways. For example, the translation may be automated, such as by providing a worm gear on the sides of the globe assembly and having, for example, a battery that supplies power to the worm gear and a switch, the operation of which causes the globe assembly to translate relative to the mantle base. In another embodiment, a spring may be provided that spring biases the globe assembly away from the mantle base so that once the mantle base is unlatched, the globe assembly automatically goes to the translated position. Such a spring 80 is shown in FIGS. 9 and 10. In the embodiment shown, the spring 80 is compressed prior to release of the globe assembly, and releases once the globe assembly is unlatched so as to push the globe assembly upward. The springs' tension may be selected so that the globe assembly is lifted the proper amount by spring action.

Different rail systems may also be used. For example, the globe may attach only at a single location to the rail 42, the rail 42 may be solid and/or curved, or other alterations to the rails may be provided, or translation may be provided without rails, as described below.

Once the globe assembly has been translated relative to the mantle base, then the mantles 26 can be accessed and replaced. Because the globe assembly is out of the way, this operation is made substantially easier. Moreover, because the globe assembly remains attached to the lantern 10, there is no concern about handling of the glass globe, or potential handling of a heated globe assembly. Keeping the globe assembly attached also simplifies the process, and does not require disassembly of the lantern 10.

Although the shown embodiment is described with reference to the globe assembly sliding upward relative to the mantle base, other translations of the globe assembly may be provided so that access to the mantles 26 may be effected. As one example, the globe 20 may be formed of two or more parts, and one of the pieces of the globe 20 may slide or hinge outward so as to provide access to the mantles 26. The globe 20 may be larger in diameter than the portion of the lantern 10 below the globe, and may slide down over those parts. The mantle base may be moved with the globe 20 remaining stationary. In addition, the globe assembly may hinge over relative to the mantle base so as to move of the way. This function is more easily provided by mantles that are attached to burner tubes that extend upward instead of downward, but other configurations of a lantern may be provided that, for example, provide sliding movement of the globe assembly and then hinging of the globe assembly so as to provide access to the mantles 26.

After the globe assembly has been moved to the translated position and the mantles 26 have been changed, then the globe assembly may be returned to the closed position. For the embodiment shown in the drawings, the user simply presses downward on the top of the ventilator cap assembly 22, or may alternatively pull down on the bail 24. The movement downward of the globe assembly is resisted by the friction generated by contact of the leaf springs 72 with the inner surfaces of the rails 70, but as described above, this resistance is preferably minimal. Again, this operation may be done using a single hand.

When the globe assembly is moved almost into contact with the frame bottom 40, the tabs 74 engage the latches 48. Because the tabs 74 are bent outward from the pan 68 and have sloped bottom surfaces, the lower part of the tabs 74 engage the corresponding latches 48 while the latches are still fully extended and, as the globe assembly is continually moved down, the sloped surfaces of the tabs 74 force the latches 48 inward against the bias of the coil spring 52. This action occurs without the user having to contact the buttons 54 or the levers 44.

When the tabs 74 are pushed down with the globe assembly to a point where they are underneath the latches 48, then the latches 48 slide over and pop into position because of the bias of the coil spring 52. Thus, by a simple movement downward of the globe assembly, the globe assembly is locked back into place.

The leaf springs 50 resist movement of the globe assembly downward, and the engagement of the tabs 74 with the latches 48 also resists movement downward. Thus, a user must provide slightly more force at the last part of closing the globe assembly. If not fully closed, then the leaf springs 50 and the coil spring 52 will force the globe assembly slightly upward so that a user can visually tell that the globe assembly is not fully closed. Moreover, the movement of the latches 48 outward over the tabs 74 causes an audible click, which serves as an indication to the user that the globe assembly has been fully closed.

In accordance with another aspect of the present invention, the globe 20 includes a unique design that reduces glare but maximizes illumination. Specifically, the globe 20 includes a frosted band 90 that extends around the globe 20 at the area of the globe 20 where the mantles 26 are located. In the embodiment shown, the frosted band 90 is approximately one and one half inches wide and extends around the entire perimeter of the globe, but other sizes for the frosted band 90 may be provided. Preferably, however, the frosted band 90 is of sufficient size so as to cover the majority of the height of the mantles 26, so that a user is prevented from viewing the mantles 26 directly through a clear portion of the globe 20 if the user is at eye level with the lantern 10.

The frosted band 90 may cover the entire circumference of the globe 20, or may extend only part way around the globe. In addition, the frosted band may be provided by a series of stripes located in the same location as the frosted band. Additionally, although referred to herein as "frosted," the band 90 may be formed of any layer or structure that reduces transmission of light relative to the rest of the globe. The frosted band 90 preferably provides some transmission of light, but blocks full transmission so that glare from the mantles 26 is minimized. Moreover, clear (nonfrosted) sections 92, 94 are provided at the top and bottom, respectively, of the globe 20. The clear sections permit large amounts of light to exit the globe 20 at angles relative to horizontal, and provide illumination without the glare problem. Although described as "clear," these sections may have tinting or some frosting, but in accordance with the present invention provide higher transmission of light than the band region of the globe. However, in any event, the fraction of light transmitted through the clear sections is greater than the fraction of light that is transmitted through the band.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

What is claimed is:

1. A lantern, comprising:

a mantle base;

a translucent or transparent lantern globe, the globe being translatable between a closed position in which the globe extends around the mantle base and an opened position in which the globe is connected to the lantern and access to the mantle base is provided; and a latching mechanism configured to releasably latch the globe in the closed position;

wherein the latching mechanism comprises a first latch operatively associated with one of the globe and the mantle base, and a first protrusion operatively associated with the other of the globe and the mantle base, the first latch being movable between a first position in which the first latch aligns with a path of the first protrusion when the globe is translated between the closed and opened positions, and a second position in which the first latch is removed from the path of the first protrusion when the globe is translated between the closed and opened positions.

2. The lantern of claim 1, wherein the first protrusion includes a sloped surface that permits the first latch to roll over the first protrusion when the first latch is in the first position and when the globe is translated between the opened and closed positions.

3. The lantern of claim 1, wherein the first latch is connected to an actuator located on the outside of the lantern.

4. The lantern of claim 1, wherein the latching mechanism comprises a second latch operatively associated with one of the globe and the mantle base, and a second protrusion operatively associated with the other of the globe and the mantle base, the second latch being movable between a first position in which the second latch aligns with a path of the second protrusion when the globe is translated between the closed and opened positions, and a second position in which the second latch is removed from the path of the second protrusion when the globe is translated between the closed and opened positions.

5. The lantern of claim 4, wherein the first path is on an opposite side of the globe from the second path.

6. A lantern, comprising:

a base;

a burner assembly mounted on the base;

a mantle base attached to the burner assembly;

a rail extending upward from the base;

a translucent or transparent lantern globe, the globe slideably mounted on the rail between a closed position in which the globe extends around the mantle base and an opened position in which the globe is removed from extending around the mantle base and access to the mantle base is provided; and a latching mechanism configured to releasably latch the globe in the first position;

wherein the latching mechanism comprises a first latch operatively associated with one of the globe and the base, and a first protrusion operatively associated with the other of the globe and the base, the first latch being movable between a first position in which the first latch aligns with a path of the first protrusion when the globe is translated between the closed and opened positions, and a second position in which the first latch is removed from the path of the first protrusion when the globe is translated between the closed and opened positions.

7. The lantern of claim 6, wherein the first protrusion includes a sloped surface that permits the first latch to roll over the first protrusion when the first latch is in the first position and when the globe is translated between the opened and closed positions.

8. The lantern of claim 6, wherein the first latch is connected to an actuator located on the outside of the base.

9. The lantern of claim 6, wherein the latching mechanism comprises a second latch operatively associated with one of the globe and the base, and a second protrusion operatively associated with the other of the globe and the base, the second latch being movable between a first position in which the second latch aligns with a path of the second protrusion when the globe is translated between the closed and opened positions, and a second position in which the second latch is removed from the path of the second protrusion when the globe is translated between the closed and opened positions.

10. The lantern of claim 9, wherein the first path is on an opposite side of the globe from the second path.

* * * * *